US007078096B2

(12) United States Patent
Konishi et al.

(10) Patent No.: US 7,078,096 B2
(45) Date of Patent: Jul. 18, 2006

(54) METHOD FOR PRODUCING POLYESTER EXTRA FINE MULTI-FILAMENT YARN AND POLYESTER EXTRA FINE FALSE TWIST TEXTURED YARN, POLYESTER EXTRA FINE MULTI-FILAMENT YARN, AND POLYESTER EXTRA-FINE FALSE TWIST TEXTURED YARN

(75) Inventors: Masahiro Konishi, Ehime (JP); Satoshi Nagamune, Ehime (JP); Hiroyuki Osaka, Ehime (JP)

(73) Assignee: Teijin Fibers Limited, Osaka (JP)

( * ) Notice: Subject to any disclaimer, the term of this patent is extended or adjusted under 35 U.S.C. 154(b) by 0 days.

(21) Appl. No.: 10/505,525

(22) PCT Filed: Apr. 25, 2003

(86) PCT No.: PCT/JP03/05360

§ 371 (c)(1),
(2), (4) Date: May 31, 2005

(87) PCT Pub. No.: WO03/091485

PCT Pub. Date: Nov. 6, 2003

(65) Prior Publication Data

US 2005/0227066 A1 Oct. 13, 2005

(30) Foreign Application Priority Data

Apr. 25, 2002 (JP) ..... 2002-123885
Jun. 21, 2002 (JP) ..... 2002-181138
Nov. 5, 2002 (JP) ..... 2002-320962

(51) Int. Cl.
*D01F 6/00* (2006.01)

(52) U.S. Cl. ..... 428/357; 428/394; 57/243; 57/318

(58) Field of Classification Search ..... 428/357, 428/364, 394; 57/248, 284, 318, 243, 328, 57/247; 264/103
See application file for complete search history.

(56) References Cited

U.S. PATENT DOCUMENTS 6,673,443 B1 * 1/2004 Koyanagi et al. ..... 428/364
7,000,375 B1 * 2/2006 Yanagihara et al. ..... 57/248

FOREIGN PATENT DOCUMENTS

| | | | |
|---|---|---|---|
| JP | 56-123409 | | 9/1981 |
| JP | 04-194036 | | 7/1992 |
| JP | 4-194036 | A | 7/1992 |
| JP | 7-305224 | A | 11/1995 |
| JP | 8-246276 | A | 9/1996 |
| JP | 10-226920 | A | 8/1998 |
| JP | 3043414 | | 3/2000 |
| JP | 2002-038341 | | 2/2002 |
| WO | WO 89/00620 | A | 1/1989 |
| WO | WO 92/13119 | A | 8/1992 |

* cited by examiner

*Primary Examiner*—N. Edwards
(74) *Attorney, Agent, or Firm*—Sughrue Mion, PLLC

(57) ABSTRACT

There are provided a process for producing a polyester fine multifilament yarn having a single filament fineness of 0.9 dtex or below, a total number of single filaments of 100 to 400 and a birefringence of 0.03 to 0.06 comprising passing polymer streams of a polyester polymer melt extruded from a spinneret surface through an atmosphere wherein a distance of 0 to 40 mm from the spinneret surface is regulated to a temperature within the range of 100 to 300° C., further cooling the polymer streams and then converging the cooled filaments into a filament bundle at a position of 350 to 500 mm from the spinneret surface; a process for producing a polyester fine false twist textured yarn comprising subjecting a polyester fine multifilament yarn having a single filament fineness of 0.9 dtex or below, a total number of single filaments of 100 to 400 and a bifringence of 0.03 to 0.06 to false twist texturing, the process comprising subjecting the multifilament yarn to air interlacing so as to provide a degree of interlacing of 50 to 90 interlaced spots/m measured for the false twist textured yarn, regulating the residence time in a draw-false twisting heater of 0.052 to 0.300 second and the temperature of the running filament yarn at the outlet of the heater to a higher temperature than the glass transition temperature (Tg) of the polyester polymer by 90 to 140° C., subjecting the multifilament yarn to simultaneous draw-false twist texturing at a draw ratio of 1.40 to 1.70 times, providing the false twist textured yarn, applying a finish oil in an amount of 1.3 to 3.0% by weight based on the weight of the false twist textured yarn and winding the resulting yarn under a winding tension of 0.05 to 0.30 cN/dtex at a speed of 500 to 1200 m/min; and a process for producing the polyester fine false twist textured yarn having a single filament fineness of 0.9 dtex or below, a total number of single filaments of 100 and 400 and a birefringence of 0.03 to 0.06 comprising subjecting a polyester multifilament yarn to the simultaneous draw-false twisting and producing the false twist textured yarn, the process comprising the polyester fine multifilament yarn to air interlacing treatment before and after the simultaneous draw-false twist texturing and regulating the degree of interlacing before and after the latter air interlacing treatment to 30 to 60 interlaced spots/m and 70 to 110 interlaced spots/m, respectively.

5 Claims, 2 Drawing Sheets

METHOD FOR PRODUCING POLYESTER EXTRA FINE MULTI-FILAMENT YARN AND POLYESTER EXTRA FINE FALSE TWIST TEXTURED YARN, POLYESTER EXTRA FINE MULTI-FILAMENT YARN, AND POLYESTER EXTRA-FINE FALSE TWIST TEXTURED YARN

TECHNICAL FIELD

The present invention relates to a process for stably producing a draw-false-twist texturable spin-oriented polyester multifilament yarn and the polyester fine multifilament yarn. In addition, the present invention relates to a process for stably producing the polyester fine false twist textured yarn and the polyester fine false twist textured yarn. Furthermore, the present invention relates to a process for stably producing the polyester fine false twist textured yarn having good performances in a weaving process or a knitting process.

BACKGROUND ART

There have been recently proposed processes for producing polyester multifilament yarns composed of fine filaments having a single filament fineness of 1 dtex or below utilizing high-speed spinning. For example, JP-A 56-123409 (hereunder, JP-A means "Japanese Unexamined Patent Application") discloses "a process for producing a polyester fine multifilament yarn comprising continuously drawing a polyester undrawn yarn obtained by high-speed spinning and having a birefringence of $1\times10^{-3}$ to $120\times10^{-3}$, a shrinkage percentage in boiling water of 20 to 60% and a single filament fineness of 1.0 de (1.1 dtex) or below without winding the polyester undrawn yarn once at 1.05 to 1.6 times." The polyester fine multifilament yarn obtained by the process is already drawn and cannot be subjected to frictional false twist texturing. Thereby, uses thereof are limited.

Furthermore, Japanese Patent Publication No. 3043414 discloses "a process for preparing a spin-oriented fine polyester multifilament yarn of denier in the range of about 1 to about 0.2 comprising melting a polyester polymer having a relative viscosity LRV in the range of about 13 to about 23, a zero-shear melting point in the range of about 240 to about 265° C. and a glass-transition temperature in the range of about 40 to about 80° C., then heating the polyester polymer to a temperature in the range of about 25 to about 55° C. above the melting temperature of the polymer at a residence time less than about 4 minutes, extruding the melt through a spinneret capillary at a mass flow rate in the range of about 0.07 to 0.7 g/min, a cross-sectional area in the range of about $125\times10^{-6}$ to about $1250\times10^{-6}$ $cm^2$ and a length (L) and a diameter (D) such that the capillary length/capillary diameter ratio (L/D) is at least 1.25 and less than about 6, protecting the extruded melt from direct cooling as it emerges from the spinneret capillary over a distance in the range of at least 2 cm and less than about 12 $dpf^{1/2}$ cm, cooling the extruded melt to below the glass-transition temperature and attenuating to an apparent spinline strain in the range of about 5.7 to about 7.6 and to an apparent internal spinline stress in the range of about 0.045 to about 0.195 g/d, then converging the cooled filaments into a multifilament bundle at a distance from the spinneret capillary in the range of about 50 to about 140 cm and winding up the multifilament bundle at a withdrawal speed in the range of about 2000 to about 6000 m/min."

To be sure, when the melt spinning of the polyester is carried out in the range of the extremely limited conditions, the spin-oriented polyester fine multifilament yarn having a birefringence of about 0.03 to about 0.1 is obtained. The fine polyester multifilament yarn having the birefringence can be subjected to frictional draw-false twist texturing. However, even under the extremely limited spinning conditions, a phenomenon in which a molten polymer just after extrusion causes droplet breakage and results in yarn breakage as the polymer throughput is reduced tends to occur simply by preventing the melt from direct cooling in a specific distance range as the molten polymer emerges from the spinneret capillary. As a result, there are increasingly frequent cases where the stable spinning is difficult. In addition, when the polymer filaments are converged into the filament bundle at the distance from the spinneret capacity in the range of about 50 to about 140 cm, there remain problems that the running state of the extruded polymer filaments becomes unstable as the total number of single filaments is increased (especially in the case of 50 filaments/spinline or above), and the uniformity of the resulting spin-oriented fine multifilament yarn is lowered (evenness U % is increased).

On the other hand, soft hand and performances such as heat reserving properties, water and moisture absorptivity of the polyester fine false twist textured yarn having a single filament fineness of 1 dtex or below are improved as compared with those of a usual polyester false twist textured yarn when converted into a fabric. Therefore, the polyester fine false twist textured yarn has been widely used in clothes uses. For example, JP-A 4-194036 discloses a water absorbing fine false twist textured yarn which is a false twist textured yarn composed of polyester multifilaments having a single filament fineness of 0.7 denier (0.78 dtex) or below and having a limited cross section flatness coefficient and a limited total crimp ratio and a process for producing the yarn. JP-A 2002-038341 discloses a polyester false twist textured yarn composed of a polyester containing a metal-containing phosphorus compound and an alkaline earth metal compound and having a single filament fineness of 0.6 dtex or below, a limited flatness coefficient and a limited thermal stress peak value and an improved depth and sharpness of color when dyed and a process for producing the yarn.

Limited performances are surely improved in the fine polyester false twist textured yarn produced by such a special limited process. When simultaneous draw-false twist texturing of a usual undrawn polyester yarn, however, is carried out under the conditions, there are problems that the resulting false twist textured yarn cannot be used as a false twist textured yarn because yarn breakage frequently occurs or fluffs or non-untwisted spot unvennesses are frequently formed in the resulting false twist textured yarn with great quality unevenness such as uneven dyeing as the number of single filaments increases and the fineness becomes small.

Further, even in the field of fine polyester fibers, speed-up of weaving and knitting is promoted in order to improve the productivity and market demands for false twist textured yarns responsive to the speed-up have been increasing. Fly wastes are easily formed and there is a tendency to increase frequency of stopping weaving in a loom when even a false twist textured yarn of good quality with slight fluffs or non-untwisted spot unevennesses is unwound at a speed as high as 1200 m/min or above. A false twist textured yarn having more improved performances in a weaving process or a knitting process is desired.

Therefore, it is a first object of the present invention to provide a process for stably producing a frictional draw-false-twist texturable spin-oriented polyester fine multifilament yarn and the polyester fine multifilament yarn.

It is a second object of the present invention to provide a process for stably producing a polyester fine false twist textured yarn with slight fluffs, non-untwisted spot unevennesses and uneven dyeing in spite of an fine multifilament yarn having a small fineness and a large number of filaments by simultaneous draw-false twist texturing and the polyester fine false twist textured yarn.

It is a third object of the present invention to provide a process for stably producing a polyester fine false twist textured yarn with slight fluffs, non-untwisted spot unevennesses and uneven dyeing in spite of a small fineness and a large number of filaments, scarcely forming fly wastes even when unwound at a high speed and having good performances in a weaving or a knitting processes.

DISCLOSURE OF THE INVENTION

As a result of intensive studies made in order to solve the problems, the inventors of the present invention have found out that the first object is achieved by "a process for producing a polyester fine multifilament yarn having a single filament fineness of 0.9 dtex or below, a total number of single filaments of 100 to 400 and a birefringence of 0.03 to 0.06, the process comprising passing polymer streams of a polyester polymer melt extruded from a spinneret surface through an atmosphere wherein a distance of 0 to 40 mm from the spinneret surface is regulated to a temperature within the range of 100 to 300° C., further cooling the polymer streams and then converging the resulting cooled filaments into a filament bundle at a position of 350 to 500 mm from the spinneret surface." and "a polyester fine multifilament yarn produced by melt spinning a polyester polymer and having a single filament fineness of 0.9 dtex or below, a total number of single filaments of 100 to 400 and a birefringence of 0.03 to 0.06, wherein the multifilament yarn satisfies (a) an evenness U % of 0.8% or below, (b) a density of 1.345 to 1.360 g/cm$^3$, (c) a shrinkage percentage in hot water (65° C.) of 25 to 55%, (d) a strength at the maximum point of 2.0 to 3.0 cN/dtex, (e) a breaking elongation of 90 to 150%, (f) a primary yield stress of 0.35 to 0.70 cN/dtex, (g) a thermal stress peak value of 0.1 to 0.2 cN/dtex and (h) a thermal stress peak temperature of Tg −10° C. to Tg +5° C. (with the proviso that Tg represents the glass transition temperature of the polyester polymer)."

Furthermore, the inventors of the present invention have found out that the second object is achieved by "a process for producing a polyester fine false twist textured yarn comprising subjecting a polyester fine multifilament yarn having a single filament fineness of 0.9 dtex or below, a total number of single filaments of 100 to 400 and a bifringence of 0.03 to 0.06 to false twist texturing, the process comprising (1) subjecting the multifilament yarn to air interlacing so as to provide a degree of interlacing of 50 to 90 interlaced spots/m measured for the false twist textured yarn, (2) regulating the residence time in a draw-false twisting heater to 0.052 to 0.300 second and the temperature of the running filament yarn at the outlet of the heater to a higher temperature than the glass transition temperature (Tg) of the polyester polymer by 90 to 140° C., subjecting the multifilament yarn to simultaneous draw-false twist texturing at a draw ratio of 1.40 to 1.70 times and providing the false twist textured yarn, (3) applying a finish oil in an amount of 1.3 to 3.0% by weight based on the weight of the false twist textured yarn and (4) winding the resulting yarn under a winding tension of 0.05 to 0.30 cN/dtex and at a speed of 500 to 1200 m/min." and "a polyester fine false twist textured yarn composed of a polyester and having a single filament fineness of 0.6 dtex or below and a total number of single filaments of 100 to 400, wherein the false twist textured yarn satisfies (i) a total crimp ratio TC of 2 to 5%, (j) a shrinkage percentage in boiling water FS of 2.5 to 4.5%, (k) a breaking strength of 3.0 cN/dtex or above and (1) a breaking elongation of 15 to 45%."

In addition, the inventors of the present invention have found out that the third object is achieved by "a process for producing a polyester fine false twist textured yarn comprising subjecting a polyester fine multifilament yarn having a single filament fineness of 0.9 dtex or below, a total number of single filaments of 100 to 400 and a birefringence of 0.03 to 0.06 to simultaneous draw-false twist texturing and producing the false twist textured yarn, the process comprising subjecting the polyester fine multifilament yarn to air interlacing treatment before and after the simultaneous draw-false twist texturing and regulating the numbers of interlaced spots before and after the latter air interlacing treatment to 30 to 60 interlaced spots/m and 70 to 110 interlaced spots/m, respectively."

BEST MODE FOR CARRYING OUT THE INVENTION

Figure 1:
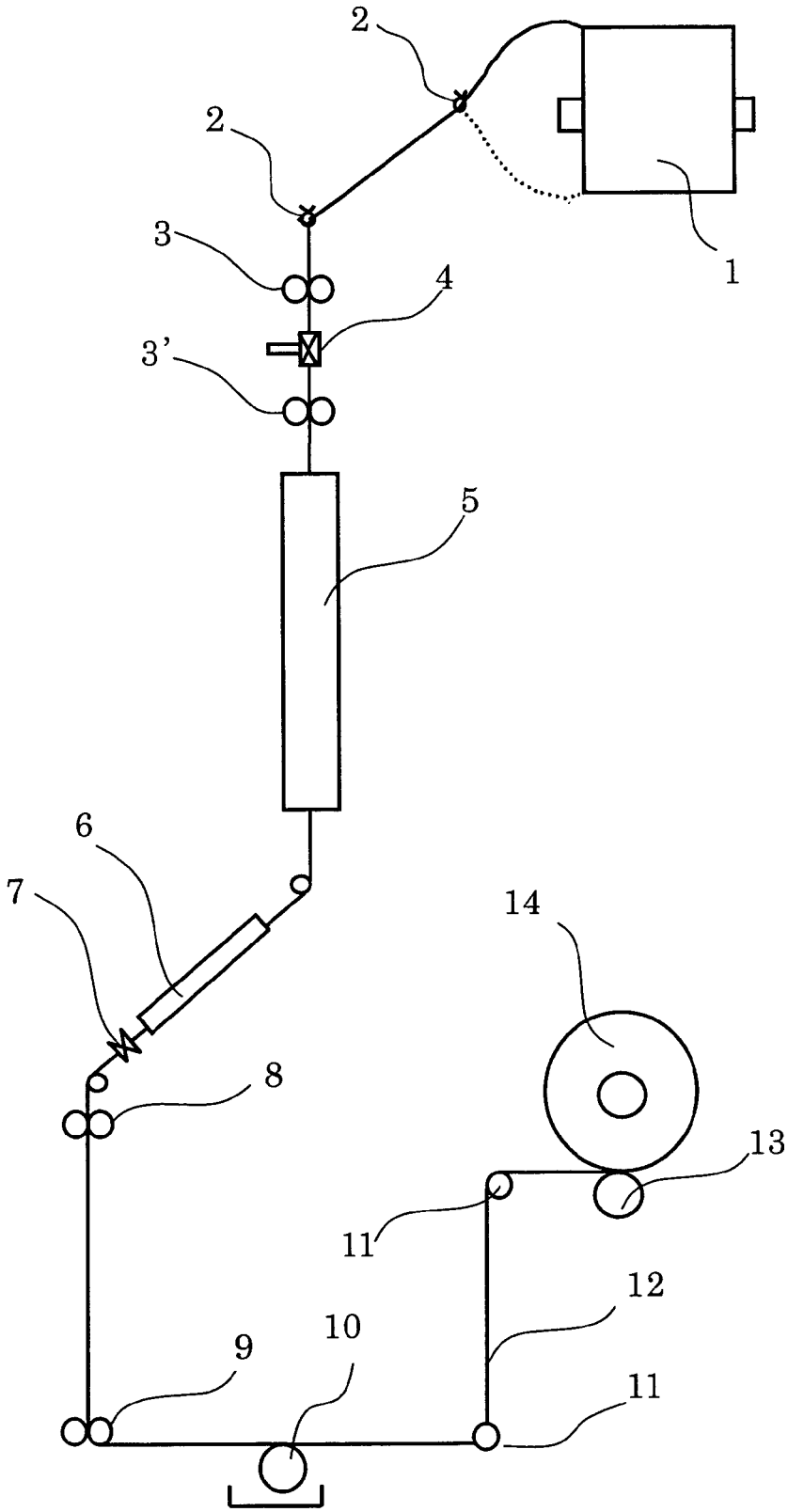
FIG. 1 and FIG. 2 are each a schematic drawing illustrating one embodiment of a simultaneous draw-false twist texturing machine used in the present invention.

First, the process for producing the polyester fine multifilament yarn and the polyester fine multifilament yarn achieving the first object of the present invention will be explained hereafter. The polyester described in the present invention is a polyester in which ethylene terephthalate as a repeating unit accounts for 85 mol % or more, preferably 95 mol % or more. The polyester may be copolymerized with a small amount (usually 15 mol % or below based on the terephthalic acid component) of a component other than the terephthalic acid component and/or ethylene glycol component. Known additives, for example, a pigment, a dye, a delustering agent, a stain resistance agent, a fluorescent brightener, a flame retardant, a stabilizer, an ultraviolet absorber or a lubricant may be contained in the polyester.

The intrinsic viscosity of the polyester used in the present invention (measured by using an o-chlorophenol solution at 35° C. as a solvent) may be 0.45 to 0.70 which is comparable to that of polyesters used as a fabric material for usual clothes. However, the polyester having an intrinsic viscosity within the range of 0.50 to 0.67 is preferably used for melt spinning of an fine multifilament yarn having a single filament fineness of 0.2 to 0.5 dtex.

The present invention is a process for producing the polyester fine multifilament yarn having a single filament fineness of 0.9 dtex or below, especially 0.6 dtex or below, a total number of single filaments of 100 to 400 and a birefringence of 0.03 to 0.06; however, the following process is preferably adopted. For example, the polyester formed into pellets is dried by a conventional method, melted in usual melt spinning equipment provided with a screw extruder, heated at a higher temperature than the melting point (Tm) of the polyester by 40 to 70° C., filtered in a spinning pack and extruded from a spinneret having 50 to 300 bored nozzles (two spinnerets are arranged in one spinning pack with less than 50 to 100 nozzles and extruded filaments are doubled and taken up). The residence time in the filtration layer during filtration is such that the intrinsic viscosity ([η]f) after cooling and solidification of the polyester melt is 0.50 to 0.60, more preferably 0.55 to 0.58. In order to stabilize the extruded polymer streams, it is preferable to keep the cross-sectional area per nozzle within the range of $7\times10^{-5}$ to $2\times10^{-4}$ $cm^2$ and the ratio (hereinafter referred to as L/D) of the length (L) to the diameter (D) of the nozzles within the range of 4 to 10 at the throughput per nozzle within the range of 0.06 to 0.20 g/min.

The extruded polymer streams are then preferably passed through an atmosphere kept warm so as not to be cooled and subsequently cooled with cooling air (preferably at a temperature of about 25° C.) from a cross-flow quench stack, converged as a filament bundle while a finish oil is applied with a guide such as a metering nozzle type oiling converging device, passed through an interlacing nozzle, intermingled and taken up at a speed of 2500 to 3500 m/min. The resulting filament bundle is preferably intermingled with the interlacing nozzle to provide 10 to 30 interlaced spots/m by taking false twist texturability into consideration.

In the present invention, in the present process for spinning, it is important that (A) the polymer streams of the polyester polymer melt extruded from the spinneret surface are passed through an atmosphere in which the temperature at a distance 0 to 40 mm from the spinneret surface is regulated at a temperature within the range of 100 to 300° C. and (B) the polymer streams are further cooled and then converged at a position of 350–500 mm from the spinneret extrusion surface.

The effects of action of the requirements in the present invention will be explained in the order of (A) and (B) hereinafter.

(A) It is well known that a phenomenon of the so-called Barus effect in which polymer streams just after extrusion from nozzles swell is caused when usual melt spinning is carried out by using a thermoplastic polymer to stabilize the extruded polymer streams and spinning can stably be carried out. When the polymer throughput is reduced so as to provide a small single filament fineness of 0.5 dtex or below, the "Barus effect" is reduced to easily produce a phenomenon in which the extruded polymer causes droplet breakage. When the temperature of the atmosphere (hereinafter referred to as a hot zone) within the range of 0 to 40 mm from the spinneret surface is less than 100° C., a phenomenon of breaking the extruded polymer into the droplet form frequently occurs and stable spinning and take-up are difficult even when the cross-sectional area per nozzle is within the range of $7\times10^{-5}$ to $2\times10^{-4}$ $cm^2$ and an L/D is within the range of 4 to 10 at the throughput per nozzle within the range of 0.06 to 0.20 g/min. On the other hand, when the hot zone temperature exceeds 300° C., the polymer streams mutually stick before the polymer streams are cooled and solidified. Therefore, the hot zone temperature must be set so as not to exceed 300° C. The extruded polymer streams can be prevented from breaking into the droplet form and stable spinning and take-up can be carried out by positively heating the distance within the range of 0 to 40 mm under the spinneret surface and keeping the hot zone temperature at 100 to 300° C., preferably 200 to 300° C. In order to heat the hot zone, it is preferable to heat not only the hot zone part but also the spinneret part of the spinning pack.

The actions of the requirements (B) of the present invention will be explained hereinafter.

In the melt spinning of a polyester having a usual single filament fineness (a single filament fineness of 1 dtex or above) and a usual total number of single filaments (less than about 50 filaments/spinline), stable spinning and take-up can usually be carried out by converging polymer filaments cooled at a distance within the range of 500 to 2000 mm from the spinneret surface. The inventors of the present invention, however, have recognized that the surge of polymer filaments is great to inhibit the uniform cooling when the polymer filaments cooled at a distance within the range of 500 to 2000 mm from the spinneret surface are converged in the case of the fine multifilament yarn having a single filament fineness less than 1 dtex and a total number of single filaments of about 100 or above (including about 50 or above/spinline×2). In the case of a polyester multifilament yarn having a single filament fineness of 0.9 dtex or below, especially a single filament fineness of 0.6 dtex or below and a total number of single filaments of 100 or above, the surge of the polymer filaments becomes violent and the uniformity (evenness U %) of the resulting polyester fine multifilament yarn becomes extremely inferior. The level dyeing properties of the textured yarn obtained by draw-false twisting a spin-oriented polyester fine multifilament yarn becomes inferior and does not withstand use. Since the extruded polymer is not sufficiently cooled in a position at a distance less than 350 mm from the spinneret extrusion surface, yarn breakage or damage to filaments occurs when contacting a guide or the like. The surge of the polymer filaments can be reduced to provide a polyester fine multifilament yarn having reduced surge of the polymer filaments and excellent uniformity (evenness U %) by converging the cooled polyester multifilament yarn at a distance within the range of 350 to 500 mm, preferably 380 to 480 mm from the spinneret extrusion surface.

The resulting polyester fine multifilament yarn has the following physical properties:

(a) an evenness U % of 0.8% or below,
(b) a density of 1.345 to 1.360 $g/cm^3$,
(c) a shrinkage percentage in hot water (65° C.) of 25 to 55%,
(d) a strength at the maximum point of 2.0 to 3.0 cN/dtex,
(e) a breaking elongation of 90 to 150%,
(f) a primary yield stress of 0.35 to 0.70 cN/dtex,
(g) a thermal stress peak value of 0.1 to 0.2 cN/dtex and
(h) a thermal stress peak temperature of Tg −10 to Tg +5° C., wherein, Tg represents the glass transition temperature of the polyester polymer used for producing the yarn.

The tension fluctuation is scarcely caused in the polyester fine multifilament yarn satisfying all the physical properties by a frictional false twisting method and stable simultaneous draw-false twist texturing thereof can be carried out to provide the resulting textured yarn having excellent level dyeing properties and physical properties thereof. (h) The preferred range of the thermal peak temperature is Tg −6 to Tg +3° C. A uniform false twist textured yarn more scarcely causing the tension fluctuation and having stabilized texturability without unevenness is obtained by keeping the thermal stress peak temperature within the range.

The method for producing the polyester fine false twist textured yarn and the polyester fine false twist textured yarn achieving the second object of the present invention will be then explained hereinafter.

Explanation of the present invention will be made according to the accompanying drawings in order to further detail the present invention. FIG. 1 is a schematic drawing illustrating one embodiment of the simultaneous draw-false twist texturing machine usable in the present invention. Numerals indicate the following. 1: Polyester multifilament yarn package, 2: Yarn guide, 3 and 3': Feed rollers, 4: Interlacing nozzle, 5: Draw-false twisting heater, 6: Cooling plate, 7: Frictional false twisting type disk unit, 8: First delivery roller, 9: Second delivery roller, 10: Finish oil applicator, 11: Yarn guide, 12: Winding tension measuring position, 13: Winding roller and 14: Draw-false twist textured yarn package.

The present invention is a process for false twist texturing a polyester fine multifilament yarn having a single filament fineness of 0.9 dtex or below, especially 0.6 dtex or below, a total number of single filaments of 100 to 400 and a birefringence of 0.03 to 0.06.

In the present invention, it is necessary that the simultaneous draw-false twist texturing of the polyester fine multifilament yarn, preferably a polyester fine multifilament yarn produced by the process described above is carried out under conditions satisfying the following (1) to (6) in a process shown in, for example FIG. 1.

First, (1) it is necessary to carry out air interlacing of the polyester multifilament yarn so as to provide a degree of interlacing measured in a false twist textured yarn of 50 to 90 interlaced spots/m, preferably 60 to 80 interlaced spots/m. In the process, the air interlacing can be applied by passing the yarn through, for example an interlacing nozzle (4 in FIG. 1). When the degree of interlacing is less than 50 interlaced spots/m, uniform twisting and drawing are inhibited over the whole multfilaments. Therefore, hairy caterpillarlike large fluffs frequently occur and uneven dyeing occurs in the false twist textured yarn. Yarn breakage is increased during draw-false twist texturing. When the degree of interlacing exceeds 90 interlaced spots/m, non-untwisted spots and fluffs are increased in the false twist textured yarn and lowering of breaking strength and elongation is caused.

Then, (2) the residence time in the draw-false twisting heater is regulated to 0.052 to 0.300 second and the temperature of the running filament yarn at the outlet of the heater is regulated to a higher temperature than the glass transition temperature (Tg) of the polyester polymer by 90 to 140° C. to carry out simultaneous draw-false twist texturing at a draw ratio of 1.40 to 1.70 times. Thereby, a false twist textured yarn is obtained.

In the process, for example a frictional false twisting tool (for example, 7 in FIG. 1) or the like is used to perform simultaneous draw-false twist texturing. It is necessary that the draw ratio is 1.40 to 1.70 times, preferably 1.5 to 1.6 times. When the draw ratio is less than 1.40 times, the texturing tension before and after the twisting tool is lowered to frequently cause non-untwisted spots or undrawn parts are left to cause uneven dyeing. When the draw ratio exceeds 1.70 times, fluffs or draw false twisting yarn breakage frequently occurs because of single filament breakage or the like.

It is necessary to carry out heat treatment so that the temperature of the running filament yarn at the outlet of the draw-false twisting heater (5 in FIG. 1) is a higher temperature than the glass transition temperature (Tg) of the polyester polymer by 90 to 140° C., preferably 110 to 130° C. and the residence time of the running filament yarn in the heater is 0.052 to 0.300 second, preferably 0.060 to 0.150 second. The running filament yarn temperature at the outlet of the draw-false twisting heater can be measured in the running yarn during draw-false twisting by using a commercially available noncontact type running object thermometer (for example H-7508 manufactured by Teijin Engineering Ltd.). When the difference between the running filament yarn temperature at the outlet of the draw-false twisting heater and the glass transition temperature (Tg) of the polyester polymer is less than 90° C. or the residence time of the running filament yarn in the heater is less than 0.052 second, the fibrous structure cannot be heat-set. Therefore, a false twist textured yarn having physical properties and crimp characteristics withstanding practical uses is not obtained. When the yarn temperature is higher than the glass temperature (Tg) of the polyester polymer by more than 140° C. or the residence time of the running filament yarn in the heater exceeds 0.300 second, the single filaments mutually stick during draw-false twist texturing to provide the yarn of quality unusable as a false twist textured yarn. The strength and elongation of the false twist textured yarn are markedly lowered to increase yarn breakage and fluffs during draw-false twisting. Either a contact type or a non-contact type may be used as the draw-false twisting heater used in the present invention; however, a heater having a heater length of 1.0 to 2.5 m is preferable.

(3) It is necessary to apply a finish oil in an amount of 1.3 to 3.0% by weight based on the weight of the draw-false twist textured yarn to the polyester multifilament yarn after the simultaneous draw-false twist texturing. Although the finish oil (consisting essentially of a mineral oil) in an amount of about 0.5 to 1% by weight based on the weight is applied to the usual false twist textured yarn, it is necessary to apply the finish oil in an amount of 1.3 to 3.0% by weight, preferably 1.5 to 2.3% by weight so that the surfaces of the respective filaments are uniformly coated with the finish oil when the single filament fineness is 0.6 dtex or below and the number of filaments is 100 or above. When the pickup of the finish oil is less than 1.3% by weight, defective yarn unwinding properties in the post-processes such as twisting, warping, knitting or weaving processes or resistance to guides is increased to extremely increase the formation of fly wastes by single filament breakage or fibrillation. When the pickup of the finish oil exceeds 3.0% by weight, accumulation of finish oil scum on the guides in the post-processes is increased. The finish oil may be applied with a roller type or a metering nozzle type finish oil applicator as indicated by 10 in FIG. 1.

(6) It is necessary to wind the resulting false twist textured yarn under a winding tension (measuring position: 12 in FIG. 1) of 0.05 to 0.30 cN/dtex, preferably 0.12 to 0.23 cN/dtex at a speed of 500 to 1200 m/min, preferably 600 to 1000 m/min (14 in FIG. 1). When the winding tension is less than 0.05 cN/dtex, yarn slackness is caused in an fine multifilament yarn having a number of filaments of 100 or above and winding cannot be carried out because of resistance to a usually used yarn guide (11 in FIG. 1) or the like. When the winding tension exceeds 0.30 cN/dtex, the winding up of a package occurs with a high winding tension to cause problems such as collapsing of paper tubes or a yarn quality difference between an inner layer and an outer layer of the false twist textured yarn package. When the winding speed is less than 500 m/min, the productivity is inferior without practicality. At a speed exceeding a winding speed of 1200 m/min, the co-called surging phenomenon such as yarn swaying between a draw-false twisting heater and a false twisting tool or on the false twisting tool is caused to make normal winding difficult. Furthermore, non-untwisted spots frequently occur.

A frictional false twisting disk unit in which urethane disks having a hardness of 75 to 95 degrees and a thickness of 5 to 12 mm are arranged on three shafts is preferably employed as the false twisting tool used in the draw false twist texturing. It is preferable to apply draw-false twisting so that the running angle of the yarn is 30 to 45 degrees relatively to the rotating shafts of the disks. It is preferable because the occurrence of fluffs can be more reduced by setting false twisting conditions so that the number of false twisting (turns/m) is (25000 to 35000)/[fineness (dtex) of the false twist textured yarn]$^{1/2}$.

The resulting polyester fine false twist textured yarn preferably has the following physical properties and is readily obtained by the process for production of the present invention.

(j) a total crimp ratio TC of 2 to 5%, (k) a shrinkage percentage in boiling water FS of 2.5 to 4.5%, (l) a breaking strength of 3.0 cN/dtex or above and (m) a breaking elongation of 15 to 45%.

The polyester fine false twist textured yarn with the physical properties has slight fluffs and non-untwisted spots and excellent uniformity (uneven dyeing) though the yarn is an fine multifilament yarn having a single filament fineness of 0.6 dtex or below and a number of filaments of 100 to 400. (m) The more preferred range of breaking elongation is 15 to 35%.

Further, the process for producing the polyester fine false twist textured yarn achieving the third object of the present invention will be explained hereinafter.

Figure 2:
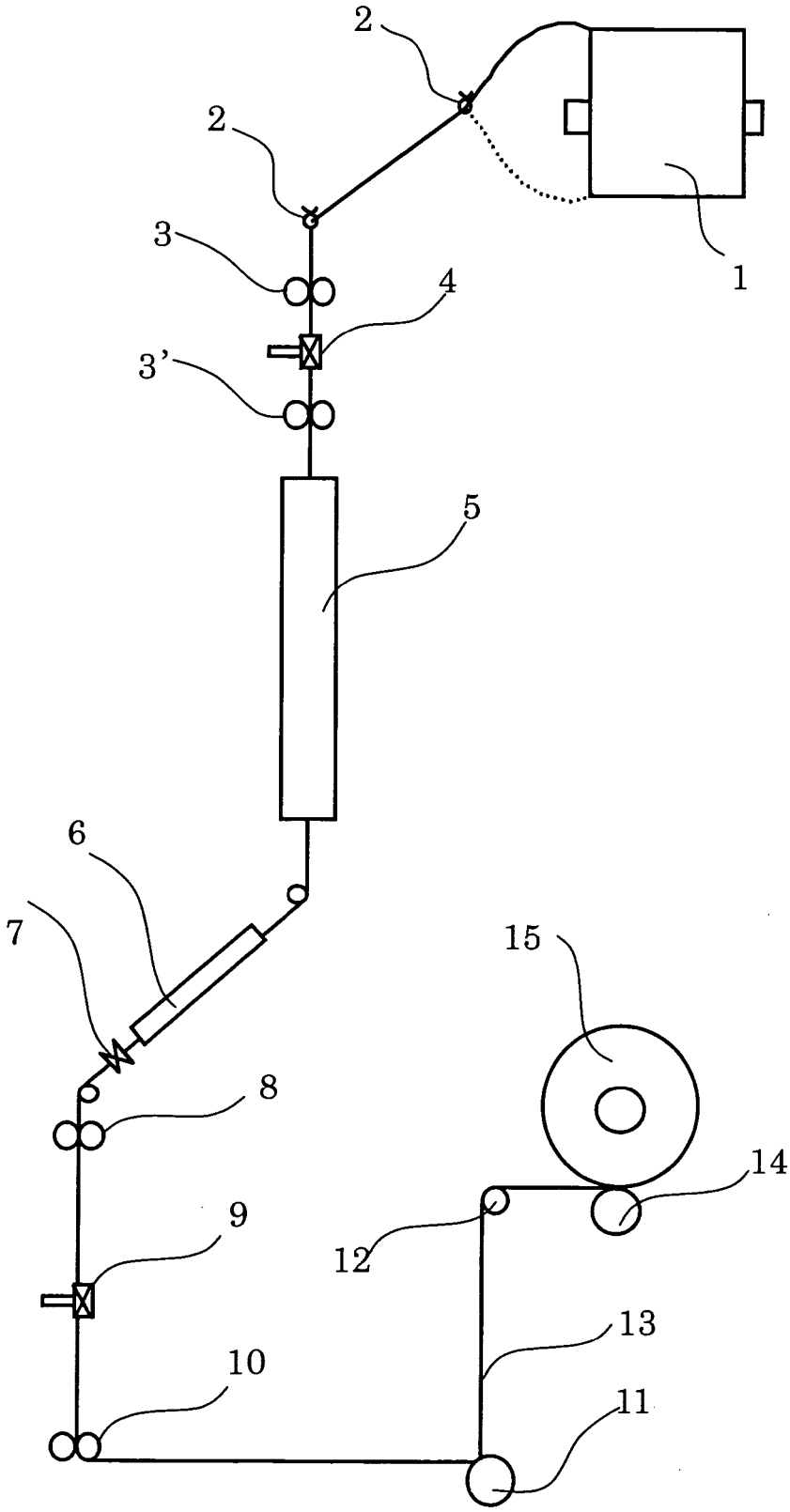

Explanation of the present invention will be made according to the accompanying drawings in order to further detail the present invention. FIG. 2 is a schematic drawing illustrating one embodiment of a simultaneous draw-false twist texturing machine usable in the present invention. Numerals indicate the following. 1: Polyester multifilament yarn package, 2: Yarn guide, 3 and 3': Feed rollers, 4: Interlacing nozzle, 5: Draw-false twisting heater, 6: Cooling plate, 7: Frictional false twisting type disk unit, 8: First delivery roller, 9: Interlacing nozzle, 10: Second delivery roller, 11: Finish oil applicator, 12: Yarn guide, 13: Winding tension measuring position, 14: Winding roller and 15: Draw-false twist textured yarn package.

The present invention is a process for false twist texturing a polyester fine multifilament yarn having a single filament fineness of 0.9 dtex or below, especially 0.6 dtex or below, a total number of single filaments of 100 to 400 and a birefringence of 0.03 to 0.06.

In the present invention, it is necessary to carry out air interlacing treatment before and after the simultaneous draw-false twist texturing in a process shown in, for example FIG. 2 and provide degrees of interlacing before and after the latter air interlacing treatment of 30 to 60 interlaced spots/m and 70 to 110 interlaced spots/m, respectively.

When the multifilament yarn is intermingled so as to provide a degree of interlacing of less than 30 interlaced spots/m before the latter air interlacing treatment in the former air interlacing treatment, uniform twisting is not applied by simultaneous draw-false twist texturing and it is difficult to carry out uniform drawing. Hairy caterpillarlike large fluffs and uneven dyeing are caused in the finally obtained false twist textured yarn and yarn breakage during simultaneous draw-false twist texturing is increased. When the degree of interlacing exceeds 60 interlaced spots/m, it is difficult to resubject the simultaneous draw-false twist textured yarn to air interlacing. In short, when a yarn once subjected to the air interlacing is subjected to simultaneous draw-false twist texturing and then resubjected to the air interlacing, parts where interlaced spots are not formed in the initial air interlacing, so-called noninterlaced parts are intermingled. When the degree of interlacing of the yarn exceeds 60 interlaced spots/m in the process, it is difficult to sufficiently intermingle a wound false twist textured yarn even if how strongly the yarn is resubjected to air interlacing treatment.

When the degree of interlacing is less than 70 interlaced spots/m after the latter air interlacing treatment, the formation of fly wastes is increased in high-speed unwinding of the false twist textured yarn in a weaving and a knitting processes. Not only the frequency of stopping weaving and knitting of a loom and a knitting machine is increased, but also the product grade of a woven or a knitted fabric is markedly deteriorated. On the other hand, when the degree of interlacing exceeds 110 interlaced spots/m, fluffs are increased in the false twist textured yarn. The breaking strength and breaking elongation of the false twist textured yarn are lowered.

In the present invention, air interlacing treatment is carried out before and after the simultaneous draw-false twist texturing as described above. In the process, the polyester fine multifilament yarn can be intermingled in a moderate balance, respectively to thereby suppress the formation of fly wastes even by high-speed unwinding at 1200 m/min or above and remarkably improve the performances in a weaving process or a knitting process. The false twist textured yarn with extremely slight fluffs, non-untwisted spots and uneven dyeing can be obtained. According to our studies, the false twist textured yarn having the excellent high-speed unwinding properties cannot be obtained by a method for carrying out air interlacing treatment either before or after the simultaneous draw-false twisting texturing.

The respective air interlacing treatments before and after the simultaneous draw-false twist texturing can be performed by using interlacing nozzles (4 and 9 in FIG. 2) as shown in, for example FIG. 2.

In the present invention, the simultaneous draw-false twist texturing is preferably carried out by regulating the residence time in the draw-false twisting heater to 0.05 to 0.30 second, preferably 0.06 to 0.15 second and the temperature of the yarn (running yarn) at the outlet of the heater to a higher temperature than the glass transition temperature (Tg) of the polyester polymer by 90 to 140° C., preferably 110 to 130° C. In the process, the draw ratio is preferably 1.4 to 1.7 times, more preferably 1.5 to 1.6 times.

Either a contact type or a noncontact type may be employed as the draw-false twisting heater used in the present invention; however, the heater length is preferably 1.0 to 2.5 m. A frictional false twisting type disk unit in which urethane disks having a hardness of 75 to 95 degrees and a thickness of 5 to 12 mm are arranged on three shafts is preferably employed as the false twisting tool used for the simultaneous draw-false twist texturing. The draw false twisting is preferably carried out so that the running angle of the yarn is 30 to 45 degrees relatively to the rotating shafts of the disks. It is preferable because the occurrence of fluffs can be more reduced by setting the false twisting conditions so that the number of false twisting (turns/m) is (25000 to 35000)/[fineness (dtex) of the false twist textured yarn]$^{1/2}$.

Furthermore, in the present invention, after carrying out the air interlacing of the yarn subjected to the simultaneous draw-false twist texturing, a finish oil in an amount of preferably 1.3 to 3.0% by weight, more preferably 1.5 to 2.3% by weight based on the weight of the yarn is applied to the yarn. The resulting yarn is then wound at a speed of preferably 500 to 1200 m/min, more preferably 600 to 1000 m/min (15 in FIG. 2). Thereby, the false twist textured yarn of the present invention can be obtained. In the process, the winding tension (measuring position: 13 in FIG. 2) is preferably 0.05 to 0.30 cN/dtex, more preferably 0.12 to 0.23 cN/dtex. The finish oil may be applied with a roller type or a metering nozzle type finish oil applicator as indicated by 11 in FIG. 2.

It is preferable that the physical properties of the false twist textured yarn are a breaking strength of 3.0 cN/dtex or above and a breaking elongation of 15 to 45% from the viewpoint of high-speed unwinding properties, weaving and knitting properties. In addition, it is preferable that the total crimp ratio of the false twist textured yarn is 2 to 5% and the shrinkage percentage in boiling water is 2.5 to 4.5% in aspects of sufficiently exhibiting performances of the false twist textured yarn of the present invention and providing a woven or a knitted fabric having excellent bulkiness. The false twist textured yarn of the present invention can readily be obtained by the process for production of the present invention.

The present invention will be more specifically explained with examples. The respective items in the examples were measured by the following methods:

(1) Intrinsic Viscosity

Measurement was made at 35° C. by using o-chlorophenol as a solvent.

(2) Glass Transition Temperature (Tg) of the Polyester Polymer

A prescribed amount of a polyester polymer was sealed in an aluminum sample pan, heated up from room temperature to 280° C. at a heat-up rate of 10° C./min under a nitrogen stream, maintained for 2 minutes, directly taken out and then quenched in a nitrogen atmosphere to prepare a sample pan in which the polymer was solidified in an amorphous state. The resulting pan was reheated up under the above conditions to measure the glass transition temperature from the obtained heat-up curve in a DSC measuring instrument.

(3) Birefringence (Δn)

The retardation of the single filament and the filament diameter were measured by using a polarizing microscope BH-2 manufactured by Olympus Optical Co., Ltd. according to a compensator method. Thereby, the birefringence was obtained.

(4) Evenness (U %)

The unevenness of fineness in the yarn longitudinal direction (yarn length: 300 m) was measured for continuous 3 minutes by setting the yarn speed at 100 n/min, the chart speed at 100 mm/2.5 min and the full scale at ±12.5% using an evenness U % measuring instrument. Thereby, the resultant average value was taken as the evenness U % of the measurement sample.

(5) Density

The density was measured by using a mixed liquid of n-heptane/carbon tetrachloride regulated so that the density is within the range of 1.276 to 1.416 according to a density gradient tube method.

(6) Shrinkage Percentage in Hot Water (65° C.)

The extent of shrinkage of a sample in a restrained state was measured when the sample was heat-treated in hot water at 65° C. for 30 minutes and taken as the shrinkage percentage in hot water (65° C.) in percentage based on the sample length.

(7) Strength at the Maximum Point, Breaking Elongation and Primary Yield Stress

The strength at the maximum point, breaking elongation and primary yield stress of an fine multifilament yarn were determined from a load elongation curve by carrying out tensile tests under conditions of a sample length of 200 mm and an elongation percentage of 20%/min using a tensile testing machine Tensilon manufactured by Shimadzu Corp.

(8) Thermal Stress Peak Value and Thermal Stress Peak Temperature

An initial load of 0.029 cN/dtex was applied to a sample formed into a hank state by using a thermal stress measuring instrument (type KE-11) manufactured by Kanebo Engineering Ltd. and heated up at a rate of 2.3° C./min to record the produced stress on a chart. Thereby, the thermal stress peak temperature and the thermal stress peak value were obtained. The thermal stress value was expressed in (cN/dtex) by dividing the stress (cN) read from the chart by the fineness (dtex).

(9) Spinning Yarn Breakage

A melt spinning machine composed of one spinning position was continuously operated under conditions of examples for 1 week, and yarn breakage caused by artificial or mechanical factors was removed. The frequency of yarn breakage occurred during the period was recorded to calculate the frequency of the yarn breakage per spinning position and day. Thereby, the resultant frequency of yarn breakage was taken as the spinning yarn breakage.

(10) Breaking Strength and Breaking Elongation

The breaking strength and breaking elongation (Table 2) in Examples 1 to 5 and Comparative Example 3 described below were determined from a load-elongation curve by carrying out tensile tests under conditions of a sample length of 100 mm and a rate of extension of 200 mm/min using a tensile testing machine Tensilon manufactured by Shimadzu Corp. The breaking strength and breaking elongation of the false twist textured yarn other than that described above were determined from a load-elongation curve by carrying out tensile tests under conditions of a sample length of 200 mm and an elongation percentage of 20%/min using the tensile testing machine.

(11) Total Crimp Ratio TC (%)

An fine false twist textured yarn under a tension of 0.044 cN/dtex (50 mg/denier) applied thereto was wound onto a reeling frame to prepare a hank of about 3300 dtex. After preparing the hank, a load of 0.00177 cN/dtex+0.177 cN/dtex (2 mg/denier+200 mg/denier) was applied to one end of the hank. The length $S_0$ (cm) after the passage of 1 minute was measured. The hank in a state freed of the load of 0.177 cN/dtex (200 mg/denier) was treated in boiling water at 100° C. for 20 minutes. The load of 0.00177 cN/dtex (2 mg/denier) was removed after the boiling water treatment and the resulting hank was naturally dried in the free state for 24 hours. A load of 0.00177 cN/dtex+0.177 cN/dtex (2 mg/denier+200 mg/denier) was reapplied to the naturally dried sample to measure the length $S_1$ (cm) after the passage of 1 minute. The load of 0.177 cN/dtex (200 mg/denier) was then removed, and the length $S_2$ (cm) after the passage of 1 minute was measured to calculate the crimp ratio according to the following formula. The measurement was made 10 times, and the crimp ratio was expressed by the average value thereof.

$$\text{Total crimp ratio } TC\ (\%)=[(S_1-S_2)/S_0]\times 100$$

(12) Temperature of Running Filament Yarn

The temperature of the running filament yarn at the outlet of the draw-false twisting heater was measured by using a noncontact running object thermometer (H-7508) manufactured by Teijin Engineering Ltd.

(13) Degree of Interlacing

The number of interlaced spots per meter was measured by using a Rothschild type interlacing measuring instrument. The measurement was carried out 10 times, and the degree of interlacing was expressed by the average value thereof.

(14) Fluffs

Fluffs of a false twist textured yarn were continuously measured at a speed of 500 m/min for 20 minutes using a model DT-104 fluff counter instrument manufactured by Toray Industries, Inc. to count the number of formed fluffs. The number was expressed as the number for $10^6$ meters.

In Examples 20 to 22 and Comparative Examples 17 to 21 (Table 8), measurement was further made at a higher sensitivity level of the instrument in order to strictly investigate even small fluffs. The number was expressed for $10^4$ meters.

(15) Non-Untwisted Spots

The fluctuation of untwisting tension was detected with a tension monitor attached to a draw-false twist texturing machine, and the tension of the limit value or above was regarded as the occurrence of non-untwisted spots. The number of non-untwisted spots was expressed for $10^6$ meters.

(16) Level Dyeing Properties

A false twist textured yarn sample was formed into a tubular knitted fabric of 30 cm length with a 12-gauge circular knitting machine. The resulting circular knitted fabric was dyed with a dye (Terasil Blue GFL) at 100° C. for 40 minutes. The level dyeing properties were visually graded according to the following standard by an inspector.

Level 1: Uniformly dyed with almost no recognized uneven dyeing

Level 2: Slightly recognized stripy uneven dyeing

Level 3: Recognized stripy uneven dyeing all over the surface.

(17) Frequency of Unwinding Yarn Breakage

Eighteen 5-kg false twist textured yarn packages were unwound at 1000 m/min, and the total frequency of yarn breakage till the unwinding of 5 kg was completed was taken as the frequency of unwinding yarn breakage.

(18) Accumulation of Finish Oil Scum

In the test on the unwinding yarn breakage frequency, the state of the finish oil scum accumulated on a yarn guide was graded into three stages by visual observation.

Level 1: Almost no recognized finish oil scum

Level 2: Somewhat recognized accumulation of finish oil scum

Level 3: Finish oil scum accumulated in a massive state on a yarn guide

(19) Formation of Fly Wastes

In the test on the unwinding yarn breakage frequency, the state of fibrillated fiber wastes (fly wastes) deposited on the yarn guide and its periphery was graded into three stages by visual observation.

Level 1: Almost no recognized fly waste

Level 2: Somewhat recognized scattered fly wastes

Level 3: Top surface of yarn guide and its periphery whitened with fly wastes

(20) Shrinkage Percentage in Boiling Water FS (%)

A fine false twist textured yarn under a tension of 0.044 cN/dtex (50 mg/denier) applied thereto was wound onto a reeling frame to prepare a hank of about 3300 dtex. After preparing the hank, a load of 0.00177 cN/dtex+0.177 cN/dtex (2 mg/denier+200 mg/denier) was applied to one end of the hank to measure the length $L_0$ (cm) after the passage of 1 minute. The hank in the state freed of the load of 0.177 cN/dtex (200 mg/denier) was treated in boiling water at 100° C. for 20 minutes. The load of 0.00177 cN/dtex (2 mg/denier) was removed after treatment in boiling water, and the resulting hank was naturally dried in the free state for 24 hours. The load of 0.00177 cN/dtex+0.177 cN/dtex (2 mg/denier+200 mg/denier) was reapplied to the naturally dried sample, and the length $L_1$ (cm) after the passage of 1 minute was measured to calculate the shrinkage percentage in boiling water according to the following formula. The measurement was carried out 10 times, and the shrinkage percentage was expressed by the average value.

Shrinkage percentage in boiling water FS (%)=$[(L_0-L_1)/L_0]\times 100$

(21) Frequency of Yarn Breakage of False Twist Texturing (Times/Ton)

A draw false twist texturing machine was continuously operated under conditions of Examples for 1 week (10-kg undrawn polyester yarn packages were subjected to draw-false twist texturing to prepare two 5-kg false twist textured yarn packages). Yarn breakage caused by artificial or mechanical factors was removed, and the yarn breakage frequency occurring during the period was recorded to express the false twist texturing frequency as frequency (of yarn breakage)/Ton.

(22) Frequency of Stopping Weaving of Loom

A false twist textured yarn was used for a weft yarn while unwinding a 5-kg false twist textured yarn package at an unwinding speed of 1,224 m/min by using weaving machinery LW550 manufactured by Toyota Industries Corporation. Thereby, weaving was continuously carried out for 1 week. In the process, the frequency of the loom frame stop with fibrillated fiber wastes (fly wastes) deposited on the yarn guide and its periphery was taken as the frequency of loom frame stop in units of frequency/kg.

EXAMPLES 1 TO 3 AND COMPARATIVE EXAMPLES 1 TO 2

Polyethylene terephthalate having a glass transition temperature (Tg) of 73° C. and an intrinsic viscosity of 0.64 and containing 0.3% by weight of titanium oxide was dried at 140° C. for 5 hours, then melted with melt spinning equipment equipped with a screw extruder, introduced into a spinning block kept at 315° C. and regulated to a residence time so as to provide an intrinsic viscosity ([η]f) of the cooled and solidified polyethylene terephthalate of 0.57. The resulting melt was filtered through a spinning pack and extruded from a spinneret provided with 272 bored nozzles having a cross-sectional area of $1.8\times10^{-4}$ $cm^2$ and an L/D of 6.0 at a throughput of 0.13 g/min per nozzle.

The extruded polymer streams were then passed through a hot zone in which an atmosphere at a distance of 30 mm from the spinneret surface was kept at a temperature shown in Table 1, respectively, cooled with cooling air at 25° C. from a cross-flow type quench stack and converged into filament bundles while applying a finish oil with a metering nozzle type oiling guide installed at a position of 420 mm (convergence length) from the spinneret surface.

The filament bundles were subsequently passed through an interlacing nozzle, intermingled and taken up with a pair of (two) godet rollers rotating at a surface speed of 3000 m/min and wound with a winder to provide a polyester fine multifilament packages (single filament fineness: 0.43 dtex).

Table 1 shows the spinning yarn breakage and physical properties of the polyester fine multifilament yarns. As can be seen from Table 1, the spinning of the polyester fine multifilament yarns can stably be carried out in Examples 1 to 3. In Comparative Example 1 wherein the hot zone temperature was lower than the scope of the present invention, dropletlike breakage of the extruded polymer frequently occurred and spinning operation could not continuously be carried out. In Comparative Example 2 wherein the hot zone temperature was higher than the scope of the present invention, extruded polymer single filaments mutually stuck, and spinning operation could not continuously be carried out.

The polyester fine multifilament yarn packages were set in HTS-1500V draw-false twist texturing machine manufactured by Teijin Seiki Co., Ltd., and simultaneous draw-false twist texturing was carried out under the following conditions using a urethane disk having a thickness of 9 mm and a diameter of 58 mm as a false twisting tool.

EXAMPLES 4 TO 5 AND COMPARATIVE EXAMPLE 3

Polyester fine multifilament packages were obtained in the same manner under the same conditions as those in Example 2, except that the 30 convergence length was changed as shown in Table 1, respectively. Furthermore, Table 1 shows spinning yarn breakage and physical properties of the polyester fine multifilament yarns in the process. The evenness U % of the polyester fine multifilament yarn obtained in Comparative Example 3 wherein the convergence length was beyond the scope of the present invention was extremely bad.

Simultaneous draw-false twisting of the polyester fine multifilament yarns was carried out in the same manner under the same conditions as those in Examples 1 to 3 to afford textured yarns having physical properties shown in Table 2. The level dyeing properties of the textured yarn in Comparative Example 3 were extremely bad and did not reach quality level withstanding use.

TABLE 1

| | Example 1 | Example 2 | Example 3 | (1) | (2) | Example 4 | Example 5 | (3) |
|---|---|---|---|---|---|---|---|---|
| (4) (° C.) | 105 | 230 | 290 | 90 | 305 | 230 | 230 | 230 |
| (5) (mm) | 420 | 420 | 420 | 420 | 420 | 350 | 500 | 550 |
| (6) | 1.2 | 0.1 | 0.5 | 18.4 | 13.2 | 0.3 | 2.1 | 5.3 |
| (7) (Δn) | 0.047 | 0.042 | 0.040 | 0.055 | 0.040 | 0.045 | 0.046 | 0.051 |
| Evenness U % | 0.4 | 0.3 | 0.4 | 1.8 | 2.5 | 0.7 | 0.8 | 3.5 |
| Density (g/cm$^2$) | 1.352 | 1.348 | 1.346 | 1.356 | 1.344 | 1.344 | 1.350 | 1.355 |
| (8) (%) | 30 | 45 | 54 | 20 | 58 | 55 | 41 | 32 |
| (9) (cN/dtex) | 2.3 | 2.3 | 2.3 | 2.3 | 2.1 | 2.1 | 2.3 | 2.4 |
| (10) (%) | 126 | 130 | 132 | 120 | 135 | 132 | 124 | 116 |
| (11) (cN/dtex) | 0.38 | 0.40 | 0.47 | 0.35 | 0.50 | 0.45 | 0.38 | 0.35 |
| (12) (cN/dtex) | 0.13 | 0.13 | 0.14 | 0.16 | 0.10 | 0.12 | 0.14 | 0.17 |
| (13) (° C.) | 70 | 71 | 72 | 72 | 72 | 71 | 72 | 72 |

Notes:
(1) means "Comparative Example 1".
(2) means "Comparative Example 2".
(3) means "Comparative Example 3".
(4) means "Hot Zone Temperature".
(5) means "Convergence Length".
(6) means "Spinning Yarn Breakage (Times/day spinning position)".
(7) means "Birefringence".
(8) means "Shrinkage Percentage in Hot Water (65° C.)".
(9) means "Strength at the Maximum Point".
(10) means "Breaking Elongation".
(11) means "Primary Yield Stress".
(12) means "Thermal Stress Peak Value".
(13) means "Thermal Stress Peak Temperature".

Draw ratio: 1.60; D (disk rotating speed)/Y (yarn speed) 1.70; heater temperature in the former half part: 400° C. and the latter half part: 250° C. and texturing speed: 700 m/min.

Table 2 shows the level dyeing properties of the resulting textured yarns and physical properties of the textured yarns. In Comparative Examples 1 to 2, the polyester fine multifilament yarn packages in an amount so as to be fed to draw-false twist texturing were not obtained.

TABLE 2

| | Example 1 | Example 2 | Example 3 | Example 4 | Example 5 | (1) |
|---|---|---|---|---|---|---|
| Dyeing Property (Level) | 1 | 1 | 1 | 1 | 2 | 3 |
| Breaking | 3.3 | 3.3 | 3.4 | 2.9 | 2.5 | 2.4 |

TABLE 2-continued

| | Example 1 | Example 2 | Example 3 | Example 4 | Example 5 | (1) |
|---|---|---|---|---|---|---|
| Strength (cN/dtex) | | | | | | |
| Breaking Elongation (%) | 21 | 22 | 22 | 24 | 18 | 15 |
| Total Crimp Ratio TC (%) | 3.2 | 3.1 | 3.1 | 2.9 | 2.5 | 2.4 |

Notes:
(1) means "Comparative Example 3".

EXAMPLES 6 TO 8 AND COMPARATIVE EXAMPLES 4 TO 5

Polyethylene terephthalate pellets having a glass transition temperature (Tg) of 73° C. and an intrinsic viscosity of 0.64 and containing 0.3 by weight of titanium oxide were dried at 140° C. for 5 hours, then melted with melt spinning equipment equipped with a screw type extruder, introduced into a spinning block kept at 315° C., filtered through a spinning pack and extruded through a spinneret provided with 288 bored circular nozzles having a diameter of 0.15 mm at a throughput of 39 g/min.

The extruded polymer streams were then passed through a hot zone in which an atmosphere at a distance of 30 mm from the spinneret surface was kept at 230° C., cooled with cooling air at 25° C. from a cross-flow quench stack, converged as filament bundles while applying a finish oil with a metering nozzle type oiling guide installed at a position (convergence length) of 420 mm from the spinneret surface, taken up with a pair (two) of godet rollers rotating at a surface speed of 3000 m/min and wound with a winder to provide undrawn polyester multifilaments (130 dtex/288 filaments) having a birefringence of 0.045.

The polyester fine multifilament packages were set in HTS-15V draw-false twist texturing machine (equipped with a noncontact slit heater of 1.04 m) manufactured by Teijin Seiki Co., Ltd., initially passed through an air nozzle and air-interlaced so as to provide a degree of interlacing shown in Table 1, respectively while unwinding the undrawn polyester yarns. The resulting yarns were subsequently run through a frictional false twisting disk unit in which urethane disks having a hardness of 90 degrees, a thickness of 9 mm and a diameter of 58 mm were arranged on three shafts so as to afford a running angle of the yarn of 40 degrees relatively to the rotating shafts of the disks and subjected to simultaneous draw-false twist texturing under conditions of number of twists×[fineness (dtex) of the false twist textured yarn]$^{1/2}$=30000 and a running filament yarn temperature of 206° C. (higher than Tg by 133° C.), a residence time in the heater of 0.089 second and a draw ratio of 1.58. A finish oil (principal component: 90% of mineral oil) for the false twist textured yarns in an amount of 1.8% by weight based on the fiber weight was applied and a winding tension of 0.18 cN/dtex was applied to wind the polyester fine false twist textured yarns (83.5 dtex/288 filaments, single filament fineness: 0.29 dtex) as packages at a speed of 700 m/min.

Table 3 shows the quality of the respective resulting polyester fine false twist textured yarns and further the yarn breakage frequency of the false twist texturing.

TABLE 3

| | (1) | Example 6 | Example 7 | Example 8 | (2) |
|---|---|---|---|---|---|
| (3) (Interlaced Spots/m) | 45 | 52 | 65 | 88 | 94 |
| (4) | 5.2 | 0.04 | 0.01 | 0.01 | 2.3 |
| (5) | 0.4 | 0 | 0 | 0.01 | 1.8 |
| (6) | 3 | 1 | 1 | 1 | 1 |
| (7) (%) | 3.0 | 3.0 | 3.3 | 2.9 | 2.8 |
| (8) (%) | 3.9 | 3.9 | 3.1 | 3.9 | 3.8 |
| (9) (cN/dtex) | 3.3 | 3.3 | 3.4 | 3.1 | 2.7 |
| (10) (%) | 22.4 | 21.2 | 28.5 | 19.4 | 14.1 |
| (11) (Times/Ton) | 19.3 | 4.1 | 2.2 | 3.2 | 3.5 |
| (12) (Times) | 6 | 0 | 0 | 0 | 0 |

Notes:
(1) means "Comparative Example 4".
(2) means "Comparative Example 5".
(3) means "Number of Interlaced Spots".
(4) means "Fluffs (Fluffs/$10^6$ m)".
(5) means "Non-untwisted Spots (Spots/$10^6$ m)".
(6) means "Level Dyeing Property (Level)".
(7) means "Total Crimp Ratio TC".
(8) means "Shrinkage Percentage in Boiling Water FS".
(9) means "Breaking Strength".
(10) means "Breaking Elongation".
(11) means "Frequency of "Yarn Breakage of False Twist Texturing".
(12) means "Frequency of Unwinding Yarn Breakage".

EXAMPLES 9 TO 10 AND COMPARATIVE EXAMPLES 6 TO 7

Polyester fine false twist textured yarns were obtained in the same manner under the same conditions as those in Example 7, except that the draw ratio was changed as shown in Table 4, respectively. Furthermore, Table 4 shows the quality of the resulting polyester fine false twist textured yarns and false twist texturing yarn breakage frequency.

TABLE 4

| | (1) | Example 9 | Example 10 | (2) |
|---|---|---|---|---|
| Draw Ratio (Times) | 1.38 | 1.40 | 1.70 | 1.75 |
| Fluffs (Fluffs/$10^6$ m) | 0.01 | 0.01 | 0.05 | 6.3 |
| (3) (Spots/$10^6$ m) | 2.9 | 0.01 | 0 | 0.01 |
| (4) | 3 | 1 | 1 | 1 |
| Total Fineness (dtex) | 95.6 | 94.2 | 77.6 | 75.4 |
| Single Filament Fineness (dtex) | 0.33 | 0.33 | 0.27 | 0.26 |
| Total Crimp Ratio TC(%) | 3.0 | 3.1 | 3.0 | 3.0 |
| (5) (%) | 4.2 | 4.2 | 3.6 | 3.6 |
| (6) (cN/dtex) | 3.0 | 3.0 | 4.1 | 4.1 |
| (7) (%) | 36.2 | 34.1 | 16.5 | 13.4 |
| (8) (Times/Ton) | 3.7 | 2.7 | 5.0 | 13.2 |

Notes:
(1) means "Comparative Example 6".
(2) means "Comparative Example 7".
(3) means "Non-untwisted Spots"
(4) means "Level Dyeing Property (Level)".
(5) means "Shrinkage Percentage in Boiling Water FS".
(6) means "Breaking Strength".
(7) means "Breaking Elongation".
(8) means "Frequency of Yarn Breakage of False Twist Texturing".

EXAMPLES 11 TO 13 AND COMPARATIVE EXAMPLE 8 TO 11

Polyester fine false twist textured yarns were obtained in the same manner under the same conditions as those in Example 7, except that the running filament yarn temperature (Tf) at the outlet of the draw-false twisting heater, the draw-false twisting heater length and the draw-false twisting speed (winding speed) and the residence time of the running filament yarns in the heater were changed as shown in Table 5, respectively. Furthermore, Table 5 shows the quality of the resulting polyester fine false twist textured yarns and the yarn breakage frequency of false twist texturing, respectively. In Comparative Examples 9 and 11, sticking of mutual single filaments frequently occurred during draw-false twisting and normal polyester fine false twist textured yarns could not be obtained.

TABLE 5

| | (1) | Example 11 | Example 12 | Example 13 | (2) | (3) | (4) |
|---|---|---|---|---|---|---|---|
| (5) (Tf)(° C.) | 159 | 163 | 193 | 213 | 218 | 213 | 163 |
| Tf-Tg*[1](° C.) | 86 | 90 | 120 | 140 | 145 | 140 | 90 |
| Heater Length (m) | 2.50 | 1.04 | 1.04 | 2.50 | 1.04 | 1.00 | 2.60 |
| (6) (sec) | 0.300 | 0.052 | 0.089 | 0.300 | 0.052 | 0.050 | 0.312 |
| (7) (m/min) | 500 | 1200 | 700 | 500 | 1200 | 1200 | 500 |
| Fluffs (Fluffs/$10^6$ m) | 1.9 | 0.02 | 0.01 | 0.01 | (*2) | 1.5 | (*2) |
| (8) (Spots/$10^6$m) | 0.01 | 0 | 0 | 0 | (*2) | 0.01 | (*2) |
| Total Crimp Ratio TC (%) | 1.8 | 2.0 | 3.2 | 4.0 | (*2) | 1.9 | (*2) |
| (9) (%) | 6.2 | 4.5 | 3.0 | 2.8 | (*2) | 4.5 | (*2) |
| (10) (cN/dtex) | 2.3 | 3.2 | 3.4 | 3.1 | (*2) | 2.6 | (*2) |
| (11) (%) | 12.6 | 22.4 | 28.8 | 20.9 | (*2) | 12.5 | (*2) |
| (12) (Times/Ton) | 14.3 | 4.6 | 2.1 | 3.4 | 23.5 | 18.2 | 34.1 |

Notes:
*[1]means "Glass Transition Temperature of Polyester Used: 73° C.
(*2) means "Unmeasurable because of Occurrence of Single Filament Sticking".
(1) means "Comparative Example 8".
(2) means "Comparative Example 9".
(3) means "Comparative Example 10".
(4) means "Comparative Example 11".
(5) means "Running Filament Yarn Temperature".
(6) means "Residence Time of Running Filament Yarn in Heater".
(7) means "Draw-false Twisting Speed".
(8) means "Non-untwisted Spots".
(9) means "Shrinkage Percentage in Boiling Water FS".
(10) means "Breaking Strength".
(11) means "Breaking Elongation".
(12) means "Frequency of Yarn Breakage of False Twist Texturing".

COMPARATIVE EXAMPLE 12

Simultaneous draw-false twist texturing was carried out in the same method under the same conditions as those in Example 2, except that a draw-false twisting heater having a length of 1.90 meters was used and the winding speed was 1270 m/min (the residence time of the running filament yarns in the heater was 0.090 second). Violent surging occurred just after starting the operation and continuous operation could not be carried out.

EXAMPLES 14 TO 16 AND COMPARATIVE EXAMPLES 13 TO 14

Fine polyester false twist textured yarns were obtained in the same manner under the same condition as those in Example 7, except that the winding tension was changed as in Table 6. Furthermore, Table 6 shows the quality of the resulting polyester fine false twist textured yarns and the frequency of false twist texturing yarn breakage, respectively. In Comparative Example 13 wherein the winding tension was leas than 0.05 cN/dtex, normal winding could not be carried out because of yarn slackness. In Comparative Example 14 wherein the winding tension exceeded 0.30 cN/dtex, 25 (number) % of paper tube collapse occurred because of winding up.

TABLE 6

| | (1) | Example 14 | Example 15 | Example 16 | (2) |
|---|---|---|---|---|---|
| Winding Tension (cN/dtex) | 0.04 | 0.05 | 0.20 | 0.30 | 0.35 |

TABLE 6-continued

| | (1) | Example 14 | Example 15 | Example 16 | (2) |
|---|---|---|---|---|---|
| Level Dyeing (Level) | — | 1 | 1 | 1 | 3 |
| (3) (Times/Ton) | (*3) | 5.2 | 2.4 | 3.6 | 3.4 (*4) |
| (4) (Times) | — | 0 | 0 | 1 | 12 |

Notes:
(*3) means "Unwindable".
(*4) means "Occurrence of 25% of Paper Tubes because of Winding up".
(1) means "Comparative Example 13"
(2) means "Comparative Example 14".
(3) means "Frequency of Yarn Breakage of False Twist Texturing".
(4) means "Frequency of Unwinding Yarn Breakage".

EXAMPLES 17 TO 19 AND COMPARATIVE EXAMPLES 15 TO 16

Polyester fine false twist textured yarns were obtained in the same manner under the same conditions as those in Example 7, except that the finish oil pickup for the false twist textured yarns was changed as in Table 7, respectively. The unwinding tests were carried out. Table 7 shows unwinding yarn breakage frequency, accumulation of finish oil scum and conditions of formation of fly wastes, respectively.

TABLE 7

| | (1) | Example 17 | Example 18 | Example 19 | (2) |
|---|---|---|---|---|---|
| (3) (%) | 1.0 | 1.3 | 2.1 | 2.9 | 3.4 |
| (4) (Level) | 1 | 1 | 1 | 2 | 3 |
| (5) (Level) | 3 | 2 | 1 | 1 | 1 |
| (6) (Times) | 9 | 0 | 0 | 0 | 0 |

Notes:
(1) means "Comparative Example 15".
(2) means "Comparative Example 16".
(3) means "Finish Oil Pickup".
(4) means "Finish Oil Scum".
(5) means "Formation of Fly Wastes".
(6) means "Frequency of Unwinding Yarn Breakage".

EXAMPLES 20 TO 22 AND COMPARATIVE EXAMPLES 17 TO 21

Polyethylene terephthalate pellets having a glass transition temperature (Tg) of 73° C. and an intrinsic viscosity of 0.64 and containing 0.3% by weight of titanium oxide were dried at 140° C. for 5 hours, melted at 315° C. with melt spinning equipment, filtered through a spinning pack and extruded through a spinneret provided with 288 bored circular nozzles having a diameter of 0.15 mm at a throughput of 39 g/min. The extruded polymer streams were then passed through a hot zone in which an atmosphere at a distance of 30 mm from the spinneret surface was kept at 230° C., cooled with cooling air at 25° C. from a cross-flow quench stack and converged as filament bundles while applying a finish oil with a metering nozzle type guide installed at a position of 420 mm (convergence length) from the spinneret surface, taken up with a pair (two) of godet rollers rotating at a surface speed of 3000 m/min and wound with a winder to provide undrawn polyester multifilaments (130 dtex/288 filaments) having a birefringence of 0.045.

The resulting undrawn polyester multifilaments were subjected to air interlacing treatment with an interlacing nozzle and run with HTS-15V draw-false twist texturing machine (equipped with a noncontact slit heater of 1.04 meters) manufactured by Teijin Seiki Co., Ltd. using a frictional false twisting disk unit in which urethane disks having a hardness of 90 degrees, a thickness of 9 mm and a diameter of 58 mm were arranged on three shafts so as to provide a yarn running angle of 40 degrees relatively to the rotating shafts of the disks and subjected to draw-false twist texturing under conditions of number of twists×[fineness (dtex) of the false twist textured yarn]$^{1/2}$=30000, a running filament yarn temperature of 206° C. (higher than Tg by 133° C.), a residence time in the heater of 0.089 second and a draw ratio of 1.58. The resulting yarns were wound without carrying out the latter air interlacing treatment, and the number of interlaced spots of the wound yarn was taken as the degree of interlacing before the latter air interlacing treatment. The flow rate of pressurized air blown from the interlacing nozzle before the draw-false twist texturing was regulated so that the degree of interlacing became values as shown in Table 8, respectively. The yarns after the simultaneous draw-false twisting texturing were continuously subjected to air interlacing treatment with the interlacing nozzle as shown in FIG. 2 and a finish oil for the false twist textured yarns (principal component: 90% of mineral oil) in an amount of 1.8% by weight based on the yarn weight was applied to the yarns after the simultaneous draw-false twist texturing. The resulting yarns were wound at a speed of 700 m/min under a winding tension of 0.18 cN/dtex applied thereto to provide polyester fine false twist textured yarn (83.5 dtex/288 filament, single filament fineness: 0.29 dtex) packages. In the process, the degree of interlacing of the wound false textured yarns was taken as the degree of interlacing after the latter air interlacing treatment. The flow rate of pressurized air blown from the interlacing nozzle was regulated so that the degree of interlacing became values shown in Table 8, respectively. The yarn breakage frequency of false twist texturing was as shown in Table 8, respectively. Furthermore, Table 8 shows the quality of the resulting polyester fine false twist textured yarns.

TABLE 8

| | (1) | Example 20 | (2) | Example 21 | Example 22 | (3) | (4) | (5) |
|---|---|---|---|---|---|---|---|---|
| (6) | 10 | 35 | 47 | 47 | 47 | 47 | 62 | 65 |
| (7) | 80 | 80 | 65 | 75 | 92 | 115 | 68 | 0 |
| (8) | 21.1 | 3.0 | 2.2 | 2.1 | 2.2 | 2.5 | 3.5 | 2.2 |
| Breaking Strength (cN/dtex) | 2.7 | 3.2 | 3.3 | 3.4 | 3.4 | 2.6 | 2.5 | 3.4 |
| Breaking Elongation (%) | 14 | 18 | 26 | 25 | 24 | 12 | 13 | 25 |
| Total Crimp Ratio TC (%) | 2.9 | 2.9 | 3.2 | 3.1 | 2.8 | 2.7 | 3.1 | 3.3 |
| (9) (%) | 3.9 | 3.9 | 3.8 | 3.9 | 4.0 | 3.9 | 3.9 | 3.1 |
| (10) (Fluffs/$10^4$ m) | 102 | 1 | 0 | 0 | 2 | 87 | 3 | 2 |
| (11) (Spots/$10^6$ m) | 2.1 | 1.1 | 0 | 0 | 0 | 0 | 0 | 0 |

TABLE 8-continued

| | (1) | Example 20 | (2) | Example 21 | Example 22 | (3) | (4) | (5) |
|---|---|---|---|---|---|---|---|---|
| (12) (Times/kg) | 0 | 0 | 2.5 | 0.2 | 0 | 0 | 2.5 | 5 |
| (13) (Level) | 1 | 1 | 3 | 2 | 1 | 1 | 3 | 3 |
| Level Dyeing Property (Level) | 3 | 2 | 1 | 1 | 1 | 1 | 1 | 1 |

Notes:
(1) means "Comparative Example 17".
(2) means "Comparative Example 18".
(3) means "Comparative Example 19".
(4) means "Comparative Example 20".
(5) means "Comparative Example 21".
(6) means "Degree of Interlacing before Latter Air Interlacing Treatment (Interlaced Spots/m)".
(7) means "Degree of Interlacing after Latter Air Interlacing Treatment (Interlaced Spots/m)".
(8) means "Frequency of Yarn Breakage of False Twist Texturing (Times/Ton)".
(9) means "Shrinkage Percentage in Boiling Water FS".
(10) means "Fluffs".
(11) means "Non-untwisted Spots".
(12) means "Frequency of Stopping Weaving of Loom".
(13) means "Formation of Fly Wastes".

INDUSTRIAL APPLICABILITY

According to the present invention, there can be provided a process for stably producing a draw-false-twist texturable spin-oriented polyester fine multifilament yarn and the polyester fine multifilament yarn.

According to the present invention, there can be provided a process for stably producing a polyester fine false twist textured yarn with slight quality defects in spite of a small fineness and a large number of filaments and the polyester fine false twist textured yarn.

Furthermore, according to the present invention, there can be provided a process for producing the polyester fine false twist textured yarn having slight fluffs, non-untwisted spot unevennesses and uneven dyeing in spite of a small fineness and a large number of filaments. The false twist textured yarn produced by the process scarcely forms fly wastes and has good performances in a weaving process and a knitting process even when unwound at a high speed of 1200 m/min or above.

The invention claimed is:

1. A process for producing a polyester fine false twist textured yarn composed of a polyester and having a single filament fineness of 0.6 dtex or below and a total number of single filaments of 100 to 400 and satisfying the following (i) to (l):

(i) a total crime ratio TC of 2 to 5%, (j) a shrinkage percentage in boiling water FS of 2.5 to 4.5%, (k) a breaking strength of 3.0 cN/dtex or above and (l) a breaking elongation of 15 to 45%, comprising subjecting a polyester fine multifilament yarn having a single filament fineness of 0.9 dtex or below, a total number of single filaments of 100 and 400 and a birefringence of 0.03 to 0.06 to simultaneous draw-false texturing and producing the false twist textured yarn, the process further comprising subjecting the polyester fine multifilament yarn to air interlacing treatment before and after the simultaneous draw-false twist texturing and regulating the degree of interlacing before and after the latter air interlacing treatment to 30 to 60 interlaced spots/m and 70 to 110 interlaced spots/m, respectively.

2. The process for producing the polyester fine false twist textured yarn according to claim 1, wherein the simultaneous draw-false twist texturing is carried out with a draw-false twisting heater so that the residence time of the yarn subjected to the initial air interlacing treatment in the heater is 0.05 to 0.30 second and the yarn temperature at the outlet of the heater is a higher temperature than the glass transition temperature (Tg) of the polyester polymer by 90 to 140° C. at a draw ratio of 1.4 to 1.7 times.

3. A process for producing a polyester fine false twist textured yarn according to claim 1 or 2, wherein the polyester fine multifilament yarn is 10 produced by a process for producing a polyester multifilament yarn having a single filament fineness of 0.9 dtex or below, a total number of single filaments of 100 to 400 and a birefringence of 0.03 to 0.06 comprising passing polymer streams of a polyester polymer melt extruded from a spinneret surface through an atmosphere wherein a distance of 0 to 40 mm from the spinneret surface is regulated to a temperature within the range of 100 to 300° C., further cooling the polymer streams and then converging the resulting cooled filaments into a filament bundle at a position of 350 to 500 mm from the spinneret surface.

4. A polyester fine false twist textured yarn composed of a polyester and having a single filament fineness of 0.6 dtex or below and a total number of single filaments of 100 to 400 and satisfying the following (i) to (l):

(i) a total crimp ratio TC of 2 to 5%, (j) a shrinkage percentage in boiling water FS of 2.5 to 4.5%, (k) a breaking strength of 3.0 cN/dtex or above and (l) a breaking elongation of 15 to 45%.

5. The polyester fine false twist textured yarn according to claim 4, wherein the false twist textured yarn is intermingled at a degree of interlacing of 70 to 110 interlaced spots/m.

* * * * *